United States Patent [19]

Iida

[11] 3,967,591

[45] July 6, 1976

[54] STEAM GENERATOR FOR FAST BREEDER REACTOR

[75] Inventor: Shoji Iida, Amagasaki, Japan

[73] Assignee: Mitsubishi Denki Kabushiki Kaisha, Tokyo, Japan

[22] Filed: Mar. 30, 1973

[21] Appl. No.: 346,330

[30] Foreign Application Priority Data

Mar. 31, 1972 Japan ..... 47-32211

[52] U.S. Cl. ..... 122/32; 165/70; 165/105; 165/154; 176/65

[51] Int. Cl.[2] ..... F22B 1/16

[58] Field of Search ..... 165/70, 105; 176/65; 122/32

[56] References Cited

UNITED STATES PATENTS

| | | | |
|---|---|---|---|
| 1,725,906 | 8/1929 | Gay | 165/105 |
| 2,948,516 | 8/1960 | Martinelli et al. | 165/70 X |
| 3,018,087 | 1/1962 | Steele | 165/105 |
| 3,532,158 | 10/1970 | Hiebert | 165/105 X |
| 3,603,382 | 9/1971 | Buzzard et al. | 165/105 |
| 3,633,665 | 1/1972 | Lombard et al. | 165/105 |
| 3,749,159 | 7/1973 | Meijer | 165/105 |
| 3,759,443 | 9/1973 | Fletcher | 165/105 X |
| 3,759,443 | 9/1973 | Freggens | 165/105 X |

*Primary Examiner*—Albert W. Davis, Jr.
*Attorney, Agent, or Firm*—Oblon, Fisher, Spivak, McClelland & Maier

[57] ABSTRACT

A steam generator for a fast breeder reactor has a partition wall having a plurality of small cells which separates a hot fluid from a cold fluid. In each of these small cells, a thermal medium, which is vaporized by a predetermined thermal input to transmit the resulting heat of gasification to the cold fluid, is sealed.

7 Claims, 4 Drawing Figures

STEAM GENERATOR FOR FAST BREEDER REACTOR

BACKGROUND OF THE INVENTION

1. Field of The Invention:

This invention relates to a steam generator for a fast breeder reactor having heat pipe structural walls which have high thermal conductivity being on the order of several times higher than the thermal conductivity of metals.

2. Description of The Prior Art:

In conventional steam generators, for example, tube and shell type steam generators, molten or liquid sodium is separated through a metal wall from water, such that the devices are structurally similar to a water loop steam generator.

Because an accidental break of the steam generator would result in a reaction of the radioactive liquid sodium with the water, an intermediate heat exchanger is provided in a primary cooling system so as to form a secondary sodium cooling loop for providing radio-inactive liquid sodium. The direct use of radioactive primary cooling liquid sodium in a steam generator has been considered and accordingly, a double walled tube, that is an outer tube covering an inner tube of the steam generator, has been proposed. However, the thermal conductivity of the wall is quite low so that this structure has not heretofore been employed. Accordingly, the secondary cooling loop is set in the primary cooling loop and the steam generator is set in the secondary cooling loop, so that should an accidental break occur, only the radio-inactive sodium is put into the steam generator, whereby the amount of damage from the accident is decreased.

However, as a present technology, it is difficult to make a steam generator in which there is no leakage of the liquid sodium. Moreover, it is presently necessary to provide a secondary cooling loop, and accordingly, the cost for construction of fast breeder reactors is remarkably higher than that of water reactors.

The conventional steam generator for a fast breeder reactor has the following disadvantages, because a steam generator for a water plant is presently used without modification:

1. It is necessary to use a secondary sodium cooling system;
2. When liquid sodium is used in the steam generator over a long period of time, a partition wall may accidentally be corroded by the molten sodium, whereupon because of the weakness thereof and subsequent failure of the wall, an accidental explosion may be caused by the reaction of the sodium with the water;
3. As a safety precaution, buildings and other constructions must have explosion resistant structure because of the consideration of such accidents, and the cost of construction accordingly is remarkably high;
4. While safety is relatively high when the partition wall of the steam generator is a double-tubed structure as hereinbefore indicated, the thermal efficiency, however, is low;
5. It is difficult to construct a reactor having no leakage from the partition wall, when an accident occurs in the steam generator; and
6. No detector for detecting a break of the partition wall of steam generators has heretofore been available. Even if such detection were available, the break occurs over a very short period of time, on the order of several seconds, and accordingly, since an increase in the amount of damage from the accident cannot be prevented within such a short period, plant operation overall is caused to be stopped.

SUMMARY OF THE INVENTION

Accordingly, an object of this invention is to simplify a plant wherein a secondary cooling system of a generator plant of a fast breeder reactor is eliminated so that the cost for construction of a cooling loop is decreased.

It is another object of this invention to provide a safety steam generator for fast breeder reactors which prevents an accident by separating a hot fluid from a cold fluid with a partition wall having a plurality of small cells, even when a part of the partition is broken.

It is still another object of this invention to provide a steam generator for fast breeder reactors having excellent thermal efficiency, wherein hot fluid is separated from cold fluid by a partition wall having a plurality of small cells and a thermal medium which is vaporized by a predetermined thermal input to transmit the resulting heat of gasification to the cold fluid is sealed in these small cells.

BRIEF DESCRIPTION OF THE DRAWINGS

These and other objects, features and attendant advantages of the present invention will be more fully appreciated as the same becomes better understood by reference to the following detailed description, when considered in connection with the accompanying drawings, wherein like reference characters designate like or corresponding parts throughout the several figures, and in which.

DETAILED DESCRIPTION OF THE PREFERRED EMBODIMENT

Figure 1:
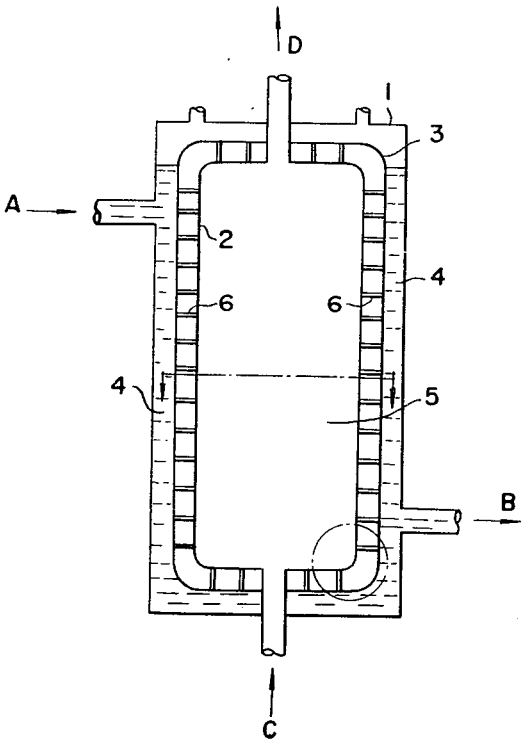
FIG. 1 is a schematic side sectional view of a preferred embodiment of a steam generator according to this invention.

Referring now to the drawing, wherein a preferred embodiment of this invention is described, the sectional view of FIG. 1 shows a steam generator for a fast breeder reactor wherein an outer shell tank 1 encloses an inner wall 2 and an outer wall 3. A hot fluid, such as liquid sodium, is separated from a cold fluid, such as water, by the thick partition wall composed of the inner wall 2 and the outer wall 3. The liquid sodium 4, or the hot fluid, enters through an inlet passage formed in the upper region of the generator between an outer shell tank 1 and the outer wall 3 and thus flows from an outlet of the nuclear reactor, not shown in the drawing, in the direction of a solid arrow line A, and is discharged from the lower part of the generator through a similar passage in the shell 1 to an inlet of the nuclear reactor in the direction of the solid arrow line B. The water 5, or the cold fluid, enters the generator through a passage in the bottom thereof surrounded by the inner wall 2, coming from an outlet of a condenser, not shown in the drawing, in the directon of the solid arrow line C, and is discharged to an inlet of a turbine, also not shown in the drawing, from an outlet in the upper region of the generator in the direction of the solid arrow line D.

Figure 2:
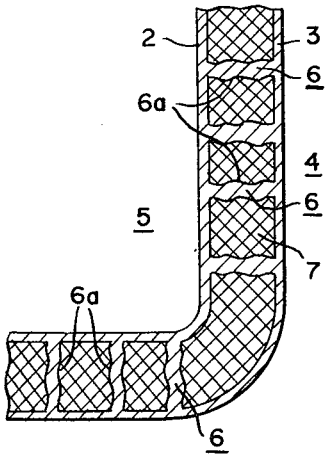
FIG. 2 is a sectional view of part of the heat pipe structural wall used in the steam generator of FIG. 1.
Figure 3:
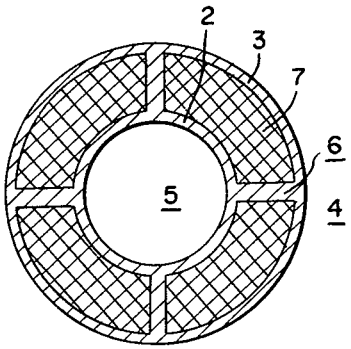
FIG. 3 is a sectional view taken along the line III—III of FIG. 1.

The area encased by the dotted chain line circle of FIG. 1 is shown in greater detail in FIG. 2, wherein a plurality of supporting plates 6 having fins are fixed on the inner wall 2 in contact with the cold fluid 5 therewithin and the outer wall 3 is in contact with the hot fluid 4 and is formed on the outer side thereof.

In a plurality of small cells surrounded by the inner wall 2, the outer wall 3 and the plates, a fine wire gauze 7, made for example of stainless steel, is packed. Moreover, the wire gauze 7 is impregnated with a liquid which is in a vapor form at the temperature of operation of the steam generator and is thus not boiled.

In the illustrated structure, therefore, the inner wall 2 and the outer wall 3 are supported with plates 6. The impregnated liquid is in a solid form at a low temperature, and is usually a low melting point metal so as to be easily handled, and a suitable amount of this low melting point metal is impregnated in the stainless steel wire gauze 7 with certain spacing. The inner parts of the cells are under vacuum or purged with an inert gas for preventing oxidation after the construction of the steam generator.

Figure 4:
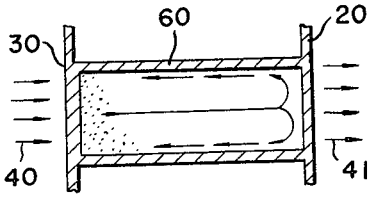
FIG. 4 is a schematic view for showing an operation in this invention.

The operation of the generator of this invention is now illustrated, referring to FIG. 4.

It is well-known that the quantity of heat Q per unit area may be expressed by the equation $$Q = \alpha \Delta t / l,$$

wherein $\alpha$ designates the thermal conductivity of a plate having a thickness l and $\Delta t$ designates a difference of temperature.

When the thickness l is increased, Q is thus decreased.

When the thermal conductivity $\alpha$ is increased, both the plate thickness l and Q can be increased. The thermal conductivity $\alpha$ of course can not be readily changed because $\alpha$ is a specific value for each substance.

In order to increase the thermal conductivity $\alpha$, a structure having high heat conductivity, that is, a so called heat pipe, has been used. As shown in FIG. 4, a liquid is sealed in a cell and when a thermal input 40 is provided, the liquid is vaporized in the cell, and the heat of gasification provided from the wall 30 is given to the wall 20 on the cold side, so that it is converted in a liquid form. The liquid is returned to the other side wall 30 by flowing on the outer wall 60.

When fine wire gauze is packed in the cell, the sealed liquid movement can be improved.

In FIG. 4, for example, the arrow lines 40 and 41 show the directions of the input and output, respectively, of heat.

In the embodiment of FIG. 2, the outer wall 60 shown in FIG. 4 is not provided.

Accordingly, a plurality of the supporting plates 6 supporting both the hot wall 3 and the cold wall 2 are used for the purpose and also a plurality of fins **6*a*** are provided for improving the cooling efficiency.

It has been known in the structure of heat-pipe that thermal conductivity is several times that of a single plate structure. However, it is possible to provide a steam generator having remarkably high thermal efficiency comparing to the conventional steam generator having a thick wall, when the wall structure characterized herein is employed.

The above-mentioned inner wall cells according to this invention have relatively large space, whereby even though an accidental break of the wall 3 contacted with the molten sodium occurs, or if the wall 2 contacted with the water is broken, the water or sodium first flows in the cells. If the liquid in the cells is liquid metal, such as mercury, an explosion usually caused by a reaction of sodium with water, does not occur. Accordingly, sodium is not directly contacted with water. Moreover, when one cell is completely separated from the other cells by the supporting plates, the leaked water or sodium is not put into the wall over the volume of the cell, so that it is unnecessary to stop the operation of the steam generator, and only the cell needs to be repaired.

It is necessary to set a detector for detecting a leakage of water or sodium in each cell. However, it is unnecessary to immerse the detector in sodium and to consider a deterioration of the detector caused by corrosion of the sodium. In the conventional steam generator wherein water is separated from sodium with a single plate wall, when an accidental leakage happens, the accident must be immediately detected and sodium or water in the steam generator should be immediately removed. However, it is almost impossible to perform such an operation in such a short time. During the operation, an explosion caused by the reaction of sodium with water, cannot be prevented. Accordingly, radioinactive sodium has been employed and the secondary cooling system is employed to reduce the damage from such accidents.

However, in accordance with this invention, an accident can be detected prior to the sodium coming into contact with the water, and the possibility of contacting sodium with water is substantially reduced, so that it is possible to directly connect the primary cooling system to the steam generator.

The cost of the steam generator of this invention is slightly higher than that of the conventional steam generator, because of the particular wall structure. However, it is possible to eliminate a secondary cooling system so that heat efficiency of the steam generator is increased and stability is increased and total construction cost can therefore still be remarkably low.

In accordance with this invention, it is possible to eliminate a secondary sodium cooling system in the fast breeder reactor, so that a cost of construction of the plant can be reduced. It is unnecessary to immediately stop the operation of the plant when the steam generator is broken, so that the design and manufacture of the controlling system and the plant equipments can be easily performed. Moreover, the operation of the fast breeder reactor can be simplified as a water reactor.

Obviously, many modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A steam generator for a fast breeder reactor which comprises:

an enclosure-type outer shell;

a substantially endless partition wall disposed within said shell in spaced relation with the inner wall of said shell so as to define an endless outer chamber between said shell and said partition wall and surrounding said partition wall for a hot fluid, and defining a substantially enclosed inner chamber centrally therewithin for a cold fluid, and having a plurality of closed, separated cells serially and continuously disposed in an endless fashion therein for separating the hot fluid from the cold fluid and for preventing fluid communication between said cells; and a thermal medium sealed within said cells.

2. The steam generator for a fast breeder reactor according to claim 1, wherein the thermal medium sealed in said cells is vaporizable by receiving a predetermined thermal input from the hot side and transmits the resulting heat of gasification to the cold side.

3. The steam generator for a fast breeder reactor according to claim 2, wherein a wire gauze is packed in said cells.

4. The steam generator for a fast breeder reactor according to claim 2, wherein an inner wall for forming said cell has fins formed thereon.

5. A steam generator for a fast breeder reactor according to claim 3, wherein said wire gauze packed in said cells is impregnated with said thermal medium, which is a low melting point metal, in a suitable amount of vaporizing.

6. A steam generator for a fast breeder reactor according to claim 5, further comprising:

inlet means for supplying said hot fluid to said outer chamber and outlet means for discharging said hot fluid therefrom; and inlet means for supplying said cold fluid to said inner chamber and outlet means for discharging said cold fluid therefrom.

7. A steam generator for a fast breeder reactor comprising:

an enclosure-type outer shell;

a first substantially endless wall disposed in spaced relation from said outer shell so as to define therewith a first substantially endless chamber interposed therebetween and surrounding said first wall within which a hot fluid may be conducted;

a second substantially endless wall disposed in spaced relation from said first wall so as to define therewith a plurality of closed, separated cells serially and continuously disposed in an endless fashion which are interposed therebetween; and a thermal medium sealed within said cells;

wherein said second wall also defines a substantially enclosed second chamber within which a cold fluid may be conducted and said plurality of closed, separated cells completely and continuously surround said second chamber so as to separate said first and second chambers and said hot and cold fluids respectively conducted therein and also prevent fluid communication between said cells.

* * * * *